US011105205B2

(12) United States Patent
Holzhaeuser et al.

(10) Patent No.: US 11,105,205 B2
(45) Date of Patent: Aug. 31, 2021

(54) ROTOR SHAFT FOR A TURBOMACHINE

(71) Applicant: ALSTOM Technology Ltd, Baden (CH)

(72) Inventors: Steffen Holzhaeuser, Nussbaumen (CH); Daniel Eckhardt, Nussbaumen (CH); Sergei Riazantsev, Nussbaumen (CH); Torsten Winge, Ennetbaden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 431 days.

(21) Appl. No.: 14/341,189

(22) Filed: Jul. 25, 2014

(65) Prior Publication Data

US 2015/0050160 A1 Feb. 19, 2015

(30) Foreign Application Priority Data

Aug. 13, 2013 (EP) ..... 13180249

(51) Int. Cl.
*F01D 5/08* (2006.01)
*F01D 5/06* (2006.01)

(52) U.S. Cl.
CPC ..... *F01D 5/082* (2013.01); *F01D 5/063* (2013.01); *F01D 5/081* (2013.01); *F01D 5/085* (2013.01); *F01D 5/087* (2013.01); *F05D 2240/60* (2013.01); *F05D 2240/61* (2013.01)

(58) Field of Classification Search
CPC ..... F01D 5/081; F01D 5/082; F01D 5/085; F01D 5/087
See application file for complete search history.

(56) References Cited

U.S. PATENT DOCUMENTS 3,876,335 A 4/1975 Forcinal et al.
3,918,835 A * 11/1975 Yamarik ..... F01D 5/081 416/95
4,910,958 A * 3/1990 Kreitmeier ..... F01D 5/081 415/117

(Continued)

FOREIGN PATENT DOCUMENTS

EP 0 926 311 A1 6/1999
EP 1 705 339 A2 9/2006
GB 2 119 861 A 11/1983

OTHER PUBLICATIONS

Chinese Office Action with English translation, corresponding to Chinese Patent Application No. 20140396288.9, issued by the Chinese Patent Office dated Dec. 5, 2016. 9 pages.

*Primary Examiner* — Woody A Lee, Jr.
*Assistant Examiner* — Behnoush Haghighian
(74) *Attorney, Agent, or Firm* — Buchanan Ingersoll & Rooney PC

(57) ABSTRACT

A rotor shaft adapted to rotate about a rotor axis thereof. The rotor shaft includes a rotor cavity configured concentrically to the rotor axis inside the rotor shaft. The rotor shaft further includes a plurality of cooling bores extending radially outward from the rotor cavity to feed cooling air into an internal cooling system in a blade. Each cooling bore includes a bore inlet portion and a distal bore outlet portion. The respective bore inlet portion ends in a plateau, projecting above the outer circumference contour of the rotor cavity. Thus, cooling bore inlets are shifted to a low stress area and the lifetime of the rotor is improved.

6 Claims, 2 Drawing Sheets

(56) References Cited

U.S. PATENT DOCUMENTS

| | | | | |
|---|---|---|---|---|
| 7,329,086 | B2 * | 2/2008 | Wiebe | F01D 5/081 415/115 |
| 8,523,526 | B2 * | 9/2013 | Riazantsev | F01D 5/082 416/193 A |
| 2008/0166222 | A1 * | 7/2008 | Yamashita | F01D 5/026 415/116 |
| 2010/0162564 | A1 * | 7/2010 | Storch | B23C 3/34 29/889 |
| 2014/0348664 | A1 * | 11/2014 | Jan | F01D 5/081 416/96 R |
| 2018/0187550 | A1 * | 7/2018 | Dobbeling | F01D 5/081 |

* cited by examiner

ROTOR SHAFT FOR A TURBOMACHINE

CROSS-REFERENCE TO RELATED APPLICATIONS

This application claims priority to European application 13180249.8 filed Aug. 13, 2013, the contents of which are hereby incorporated in its entirety.

TECHNICAL FIELD

The present invention relates to the technical field of turbomachines, subjected to high thermal load, especially gas turbines, and, more particularly, the invention relates to a rotor shaft for such a turbomachine.

BACKGROUND

Components of turbomachines, such as compressors, gas turbines or steam turbines, are exposed to high thermal and mechanical stresses, reducing the lifetime of these components. To reduce thermal stress during operation, these components are cooled by a cooling medium, e.g. steam or air.

In gas turbines, the blades are convectively cooled by cooling air. The cooling air is branched off from the compressor and is directed into a central cooling air supply bore inside the rotor shaft. From this central bore the cooling air is directed radially outwards through a rotor cavity and a plurality of individual radially extending cooling bores into internal cooling channels of the blades.

EP 1705339 discloses a rotor shaft for a gas turbine with a cooling air supply disposed inside the rotor shaft in form of a central axially extending bore and a plurality of individual cooling air ducts which run from the central cooling air supply outwards in an essentially radial direction to the blades to be cooled. These cooling air ducts feed cooling air into the internal cooling channels of the blades. According to a preferred embodiment the cooling air ducts emanate from cavities, concentrically arranged with respect to the rotor axis. A critical area of this structure is the section of the cooling air duct inlets at the outer circumference of these rotor cavities. The multiple cooling bores start in the curved outer section of the rotor cavities. They are distributed symmetrically along the outer circumference of the rotor cavities. Due to the high required cooling air mass flow, the number and size of the cooling air bores are given and lead to a very small remaining wall thickness between the individual cooling air bores. From this follows a weakening of rotor shaft rigidity. Due to the high acting stresses in this area the small wall thickness leads to a limited lifetime of the rotor.

In order to increase the minimum wall thickness, the number and/or size of the cooling bores would need to be changed. Or alternatively, the acting mechanical (centrifugal blade load) and thermal loads would need to be reduced. However, these options all together have a negative impact on the blade cooling and/or on the engine performance.

Accordingly, there exists a need for an improved rotor shaft design for reducing the mechanical stresses and to increase the lifetime of the rotor shaft in a thermally loaded turbomachine.

SUMMARY

It is an object of the present invention to provide a rotor shaft for a turbomachine, subjected to high thermal load, such as a gas turbine, being equipped with a multiplicity of radially extending cooling bores, which rotor shaft is advantageous over said state of the art especially with regard to its lifetime.

This object is obtained by a rotor shaft according to the independent claim.

The rotor shaft according to the invention at least comprises a cooling air supply disposed inside the rotor shaft and extending essentially parallel to the rotor axis, at least one rotor cavity, arranged concentrically to the rotor axis inside the rotor shaft, whereby the cooling air supply opens to the at least one rotor cavity, a number of cooling bores, connected to the at least one rotor cavity and extending radially outwards from this rotor cavity, each cooling bore having an inlet portion and a distal outlet portion, the respective bore inlet portion being adapted to abut on an outer circumference of the at least one rotor cavity. This rotor shaft is characterized in that an inlet portion of at least one cooling bore is formed as a plateau, projecting above the outer circumference contour of the rotor cavity wall.

It is an advantageous effect of this measure that the cooling bores are thereby extended further into the rotor cavity and the cooling bore inlets are shifted away from the original cavity contour into an area of low stress. As a consequence the mechanical stress of the rotor is significantly reduced and a reduced mechanical stress of the rotor is a factor to increase its lifetime.

According to a preferred embodiment of the invention the inlet section of each cooling bore is arranged on an individual plateau.

According to an alternative embodiment the inlet sections of a number of cooling bores are arranged on a plateau in common.

According to a further embodiment a circumferential plateau is formed in the rotor cavity and the inlet sections of all cooling bores end in this circumferential plateau.

The advantage of the circumferential plateau is its easy manufacture.

At its radially outer part the plateau is lifted away from the original contour via a relatively small radius, forming a step on the cavity wall.

This introduced step prevents any changes of the original stress distribution.

At its radially inner part, in the direction to the rotor axis, the plateau has a smooth tangential transition to the cavity wall.

The plateau itself may have a curved surface. But from reason of an easy manufacture a plateau with a straight surface is preferred. The surface of a straight plateau is aligned perpendicularly to the longitudinal axis of the cooling bores.

BRIEF DESCRIPTION OF THE DRAWINGS

The present invention is now to be explained in more detail by means of different embodiments with reference to the accompanying drawings.

Like reference numerals refer to like parts throughout the description of several embodiments.

DETAILED DESCRIPTION

For a thorough understanding of the present disclosure, reference is to be made to the following detailed description in connection with the drawings.

Figure 1:
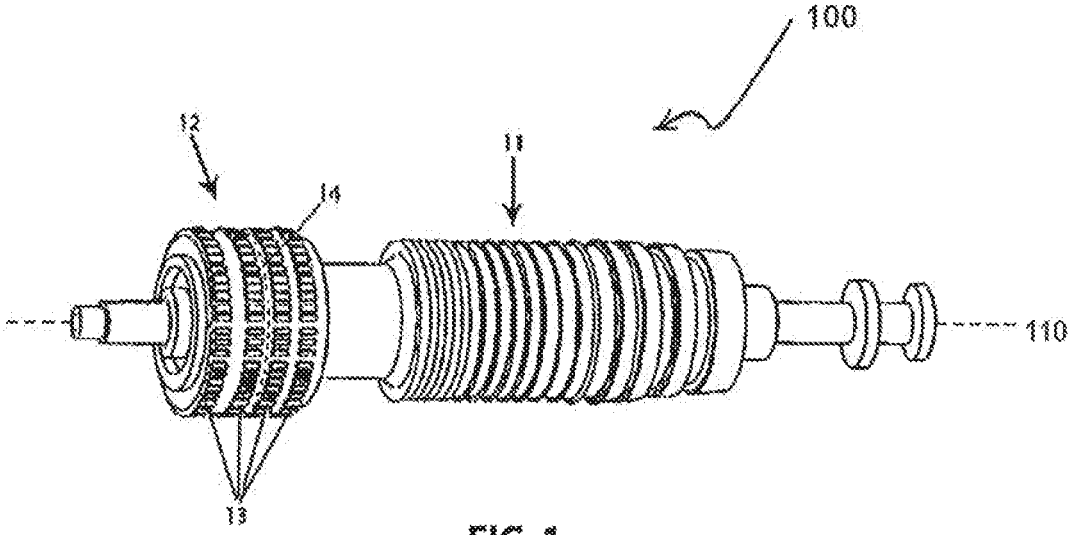
FIG. 1 illustrates a perspective side view of a rotor shaft (without blading) in accordance with an exemplary embodiment of the present invention.

FIG. 1 reproduces a perspective side view of a rotor shaft 100 (blading not shown) of a gas turbine. The rotor shaft 100, rotationally symmetric with respect to a rotor axis 110, is subdivided into a compressor part 11 and a turbine part 12. Between the two parts 11 and 12, inside the gas turbine, a combustion chamber may be arranged, into which air compressed in the compressor part 11 is introduced and out of which the hot gas flows through the turbine part 12. The rotor shaft 100 may be assembled by a number of rotor discs 13, connected to one another by welding, The turbine part 12 has reception slots for the reception of corresponding moving blades, distributed over the circumference. Blade roots of the blades are held in the reception slots in the customary way by positive connection by means of a fir tree-like cross-sectional contour.

Figure 2:
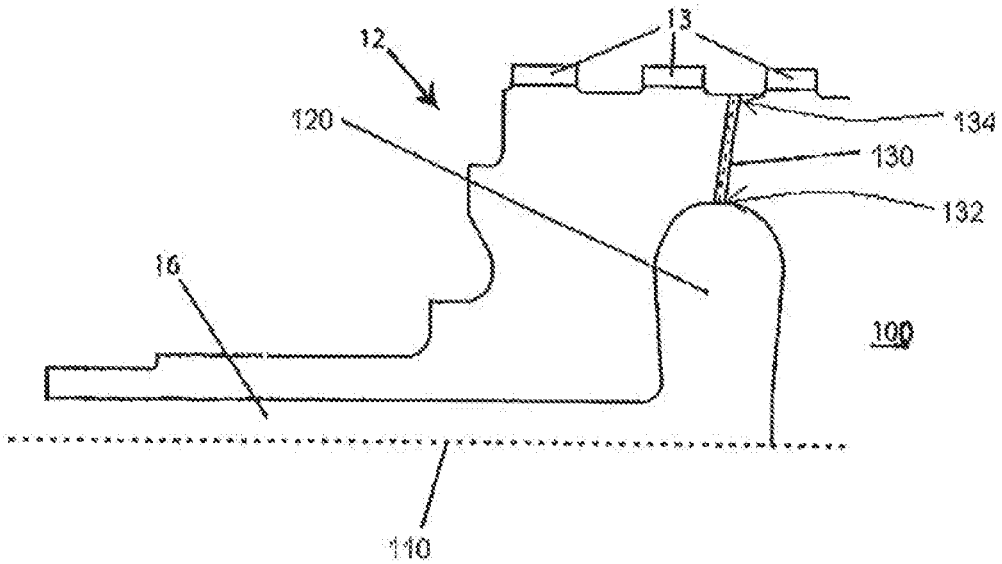
FIG. 2 schematically illustrates a longitudinal section through the rotor shaft of FIG. 1 in a region equipped with inner cooling air ducts.

According to FIG. 2, showing the turbine part 12, subjected to high thermal load, the rotor shaft 100 includes a cooling air supply 16, running essentially parallel to the rotor axis 110 and ending in a rotor cavity 120. The rotor cavity 120 is configured concentrically to the rotor axis 110 inside the rotor shaft 100. A plurality of cooling bores 130 extends radially outwards from the rotor cavity 120 to an outside of the rotor shaft 100 for feeding cooling air into internal cooling channels of the individual blades (not shown), connected to the rotor shaft 100. Each cooling bore 130 includes a bore inlet portion 132 and a distal bore outlet portion 134. The respective bore inlet portion 132 being adapted to abut on the rotor cavity 120. The term 'abut' is defined to mean that the bore inlet portion 132 and the rotor cavity 120, whereat the bore inlet portion 132 meets, share the same plane. The rotor cavity 120 is connected to the central cooling air supply 16 which supplies the cooling air to the rotor cavity 120, and from there to the plurality of cooling bores 130.

Figure 3:
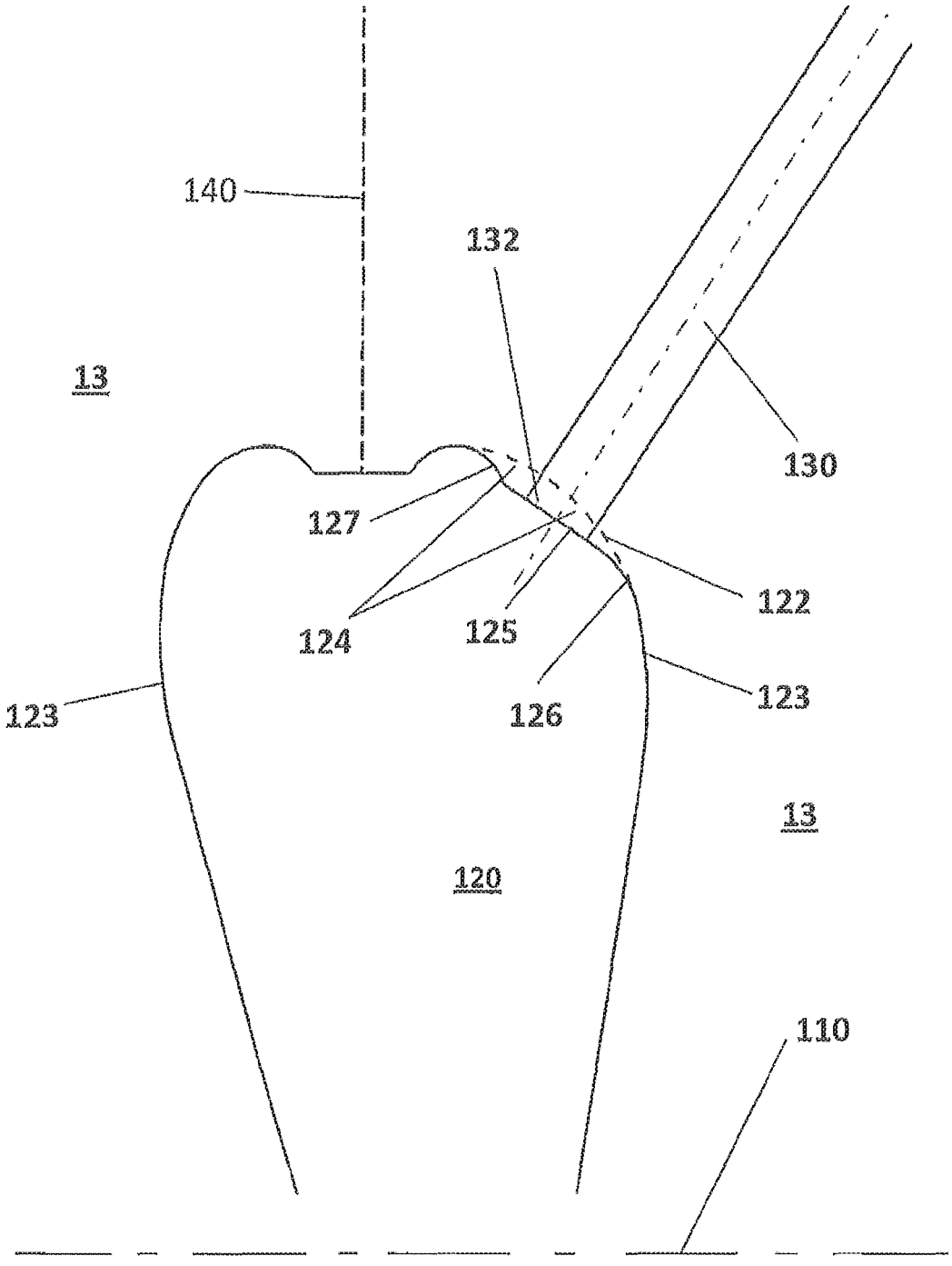
FIG. 3 illustrates an enlarged view of a rotor cavity in accordance with the present invention.

As shown in FIG. 3, the annular rotor cavity 120 is axially and circumferentially limited by a cavity wall 123. Reference numeral 140 symbolizes a welding seam between adjacent rotor discs 13. From an radially outer section of the rotor cavity 120 (basis for the terms "radially outer", "radially inner", "radially outward", as herein referred, is the rotor axis 110), a number of cooling bores 130 extends radially outwards. The inlets 132 of the cooling bores 130 are shifted away from the original cavity contour 122 and are located in distance thereof on a plateau 124 of added material. Ideally, the material is only added around each of the cooling bore inlets 132 so to form a plateau 124 around each individual cooling bore inlet 132. The cooling bores 130 are thereby extended further into the rotor cavity 120 and their inlets 132 are shifted away from the original cavity contour 122. Preferably the plateau 124 has a straight surface 125, aligned perpendicularly to the longitudinal axis of the cooling bore 130. On its radially inner part, i.e. in the direction to the rotor axis 110, the plateau 124 has a smooth, tangential transition 126 to the cavity wall 123, whereas on its radially outer part, the transition from the cavity wall 123 to the plateau 124 is formed by a step with a relatively small transition radius 127 from the cavity wall 123 to the platform 124. The expression "relatively small" means in comparison to transition radius 126. Due to the added material the cooling bore inlets 132 are shifted further into the cavity 120 and away from the original contour 122. The introduced step 127 prevents any changes of the original stress distribution. Thus the cooling bore inlets 132 are shifted to a low stress area.

Instead of making a plurality of individual plateaus 124 in accordance with the number of cooling bores 130 it is a preferred alternative to form a continuous plateau 124 of equal height along the whole circumference of the rotor cavity 120. The advantage of this embodiment is its easy manufacture.

The improved rotor shaft of the present disclosure is advantageous in various scopes. The rotor shaft may be adaptable in terms of reducing effect of thermal and mechanical stresses arise thereon while a machine or turbines in which relation it is being used is in running condition. Further, independent of factor whether the rotor shaft of the present disclosure being made of single piece or of multiple piece, the rotor shaft of the present disclosure is advantageous in withstanding or reducing effects of temperature and centrifugal or axial forces. The improved rotor shaft with such a cross-sectional profile is capable of exhibiting the total life cycle to be increased by 2 to 5 times of the conventional rotor in the discussed location. The rotor shaft of present disclosure is also advantageous in reducing the acting stresses in the area of the bore inlet by 10 to 40%. The acting stresses are a mixture of mechanical and thermal stresses. Further, the rotor shaft is convenient to use in an effective and economical way. Various other advantages and features of the present disclosure are apparent from the above detailed description and appendage claims.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

The invention claimed is:

1. A rotor shaft for a thermally stressed turbomachine, comprising:

plural rotor disks, wherein adjacent rotor disks are connected by a welding seam;

a cooling air supply disposed inside the rotor shaft and extending essentially parallel to a rotor axis; and at least one rotor cavity, arranged concentrically to the rotor axis inside the rotor shaft, whereby the at least one rotor cavity receives cooling air via the cooling air supply, discharges cooling air via one or more outlets, and extends about the welding seam connecting the adjacent rotor disks, the at least one rotor cavity being axially and circumferentially limited by a cavity wall; and a number of cooling bores, each cooling bore having an inlet portion connected to a respective outlet of the at least one rotor cavity and a distal outlet portion that discharges the cooling air outside the rotor shaft, wherein an outer contour of the at least one rotor cavity has:

at least one plateau around the inlet portion of each cooling bore;

the plateau having:

a straight surface, aligned perpendicularly to the longitudinal axis of the cooling bore;

a first transition, which extends from the inlet portion of the cooling bore on a first end of the straight surface to the cavity wall in a direction toward a rotor axis; and a second transition, which extends from the inlet portion of the cooling bore on a second end of the straight surface to the cavity wall on a second side of each cooling bore in a direction away from the rotor axis, wherein a transition radius of the first transition at the first end of the straight surface to the cavity wall in the direction toward the rotor axis changes at a slower rate than a transition radius of the second transition comprises a step at the second end of the straight surface to the cavity wall in the direction away from the rotor axis.

2. The rotor shaft as claimed in claim 1, wherein each plateau includes two or more discharge outlets.

3. The rotor shaft as claimed in claim 1, wherein the at least one rotor cavity includes a plurality of rotor cavities and the plateau, wherein the plateau extends the contour each rotor cavity and is continuous between the plurality of rotor cavities.

4. The rotor shaft as claimed in claim 1, wherein the second transition comprises a step and the transition radius of the second transition relative to the step is smaller than the transition radius of the first transition.

5. The rotor shaft as claimed in claim 4, wherein the step is designed as a has at least one rounded edge associated with the transition radius of the second transition.

6. The rotor shaft as claimed in claim 1, wherein the turbomachine is a gas turbine.

* * * * *